US006029778A

United States Patent [19]

Lacarte Estallo

[11] Patent Number: 6,029,778

[45] Date of Patent: Feb. 29, 2000

[54] CONTROL PANEL FOR A LIFT CAGE

[75] Inventor: Jose Luis Lacarte Estallo, Saragossa, Spain

[73] Assignee: Inventio AG, Hergiswil NW, Switzerland

[21] Appl. No.: 09/027,937

[22] Filed: Feb. 23, 1998

[30] Foreign Application Priority Data

Mar. 6, 1997 [SE] Sweden ..... 0533/97

[51] Int. Cl.[7] ..... B66B 7/00

[52] U.S. Cl. ..... 187/414; 187/395

[58] Field of Search ..... 187/395, 396, 187/397, 391, 414

[56] References Cited

U.S. PATENT DOCUMENTS 4,779,707 10/1988 Smith et al. ..... 187/1 R

FOREIGN PATENT DOCUMENTS 190407 8/1986 European Pat. Off. .

2659636 9/1991 France ..... 187/395

*Primary Examiner*—Kenneth W. Noland

*Attorney, Agent, or Firm*—Schweitzer Cornman Gross & Bondell LLP

[57] ABSTRACT

A control panel for a lift cage is in the form of a wall element which is engageable with adjacent wall elements to form a continuous, smooth wall surface particularly resistant to vandalism. The control panel has opposed doubly bent edges having slots which engage pins extending outwardly from the edges of the adjacent wall elements. The control panel may be easily installed between the adjacent wall elements by a horizontal insertion followed by a dropping of the control panel into an end position.

9 Claims, 2 Drawing Sheets

CONTROL PANEL FOR A LIFT CAGE

BACKGROUND OF THE INVENTION

A cage control panel with a housing made from a U-shaped profile member has become known from patent specification EP 0 190 407. The housing, consisting of side walls and a back wall, is open at the front side of the cage control panel, wherein the frontal edges of the side walls are provided with flanges by which the housing bears against a wall of the lift cage. Grooves, in which guides are displaceably inserted, are provided at the inner sides of the side walls. Mounting plates are held at their edges in the guides. Switches for the input of control commands such as cage calls, and indicator lamps for the indication of stored control commands, are fastened to the mounting plates. The switches and indicators may take the form of microswitches and luminescent diodes, respectively.

The protruding parts of the housing, including the switches and the indicator lamps, represent a deficiency in such equipment. The protruding parts represent a risk of injury for the lift passengers and promote vandalism.

BRIEF DESCRIPTION OF THE INVENTION

The present invention provides a remedy to such deficiencies. The invention comprises a control panel which is flush with the cage wall and is easily mountable and demountable.

The advantages achieved by the invention are achieved through a construction which allows the cage control panel to appear as a component of the cage wall. Thus, the control panel has rearwardly facing limbs having connection means which engage pins which are mounted to the wall elements, the edges of which define the space into which the control panel is to be mounted. Fastening means are not visible externally. Although the control panel is mounted and demounted from the cage interior (i.e. the passenger space), it is not apparent to the lift passengers how the control panel is demountable. The risk of vandalism is thus substantially eliminated. The control panel can be mounted and demounted easily by an authorized worker without great effort during construction of the lift cage or during maintenance operations.

BRIEF DESCRIPTION OF THE DRAWINGS

The present invention is explained in more detail in the following detailed description of a preferred illustrative embodiment, in association with the annexed drawings, wherein.

DETAILED DESCRIPTION OF THE INVENTION

Figure 1:
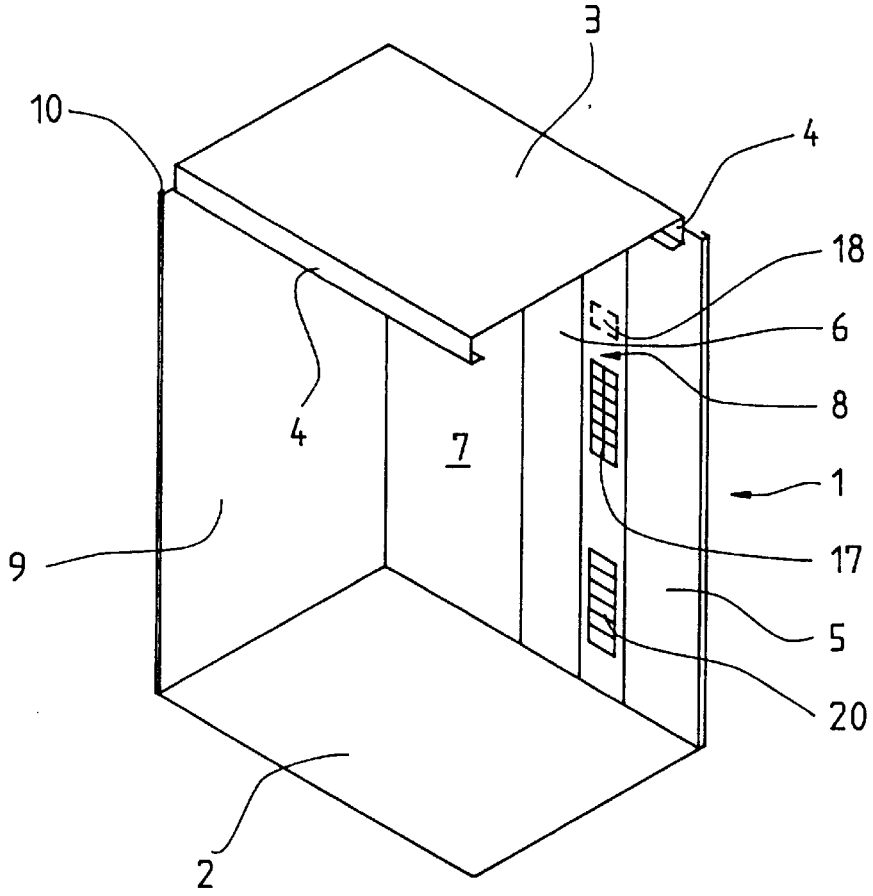
FIG. 1 presents a schematic representation of a lift cage having a floor, ceiling and walls and a control panel wall element.
Figure 3:
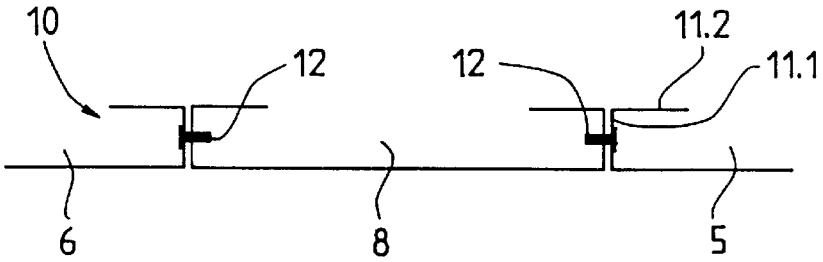
FIG. 3 presents a schematic detail of the fastening of the control panel wall element.

With reference to the figures, a lift cage 1 built in a piecewise or element mode of construction consists of a floor element 2 and a ceiling element 3 having bent-over ends 4, to which wall elements 5, 6, 7, 8 and 9 are fastened. Not illustrated are the bent-over ends of the floor element 2, to which the wall elements 5, 6, 7, 8 and 9 are similarly fastened in the floor region. A first side wall element 5, a second side wall element 6, a third side wall element 7, a control wall element 8 and a back wall element 9 are depicted. The elements of a second side wall, as well as the cage doors of the lift cage, are not shown. The wall elements 5, 6, 7, 8 and 9 have at their longitudinal edges doubly bent-over U-shaped ends 10, consisting of a first limb 11.1 and a second limb 11.2, by which the wall elements are interconnected by means of, for example, screws or clips 2.

Figure 2:
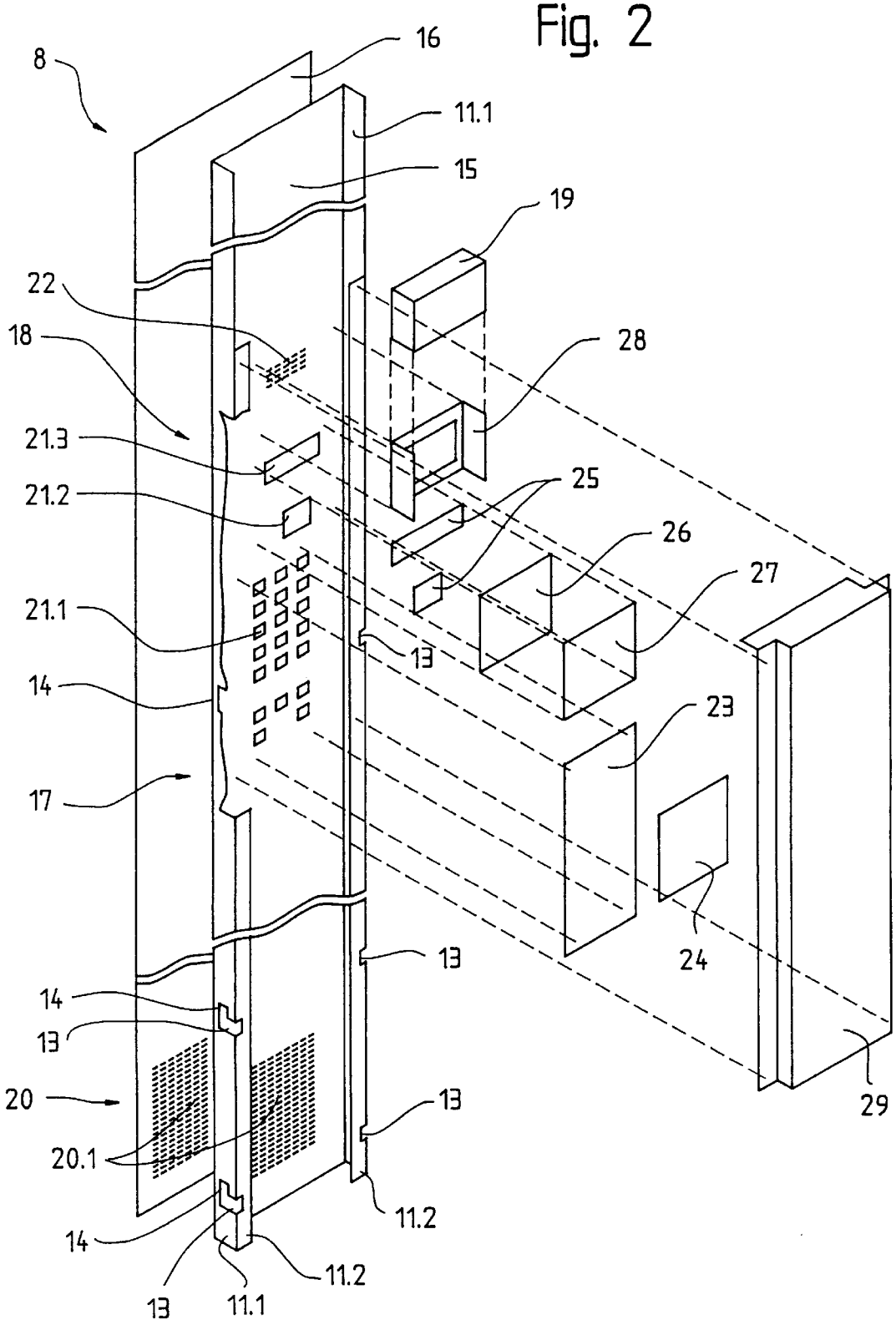
FIG. 2 presents an exploded detail view of the control panel wall element of the present invention.

After the mounting of the side wall elements 5, 6, 7 and 9 the control wall element 8 is inserted in the space reserved therefor, such as the space between the first side wall element 5 and the second side wall element 6. The insertion is done from the passenger or interior space of the cage. As seen in FIG. 2, pins 12 arranged between the first limbs 11.1 of the side wall elements 5 and 6 engage guide slots located on the corresponding limbs 11.1 and 11.2 of the control panel element 9. The guide slots comprise a horizontal guide slot 13 which extends in the limb 11.1 rearwardly through limb 11.2 and a vertical guide slot 14 projecting upward from the forward portion of horizontal guide slot 13. Thus, it may be appreciated that the control panel wall element 8 is guided horizontally into the wall opening, the pins 12 first passing within the horizontal guide slots 13, and subsequently vertically guided downward, the pins passing into the vertical guide slots 14, as the control panel drops down into the end installed position. The upper end of the control panel wall element 8 is then connected to or covered by the bent-over ends 4 of the ceiling element 3. The control panel wall element 8, together with the side wall elements 5, 6 and 7, forms a cage wall which is flat and continuous on the interior passenger space side of the cage and thus vandal-resistant.

As detailed in FIG. 2, the control panel wall element 9 includes a base plate portion 15, the edges of which form the limbs 11.1 and 11.2 which may be lined or overlaid on the passenger space side by a flexible film 16. The wall element 9 serves as an apparatus support for a call transmitter 17, a story indicator 18, and a loudspeaker 19. First perforations 20.1 at the lower end of the base plate 15 and film 16 form a ventilation opening means 20. The base plate 15 also has first recesses 21.1 for a call transmitter 17, second and third recesses 21.2 and 21.3 for a story indicator 18, and a second perforation 22 for a loudspeaker 19. A small plate 23 with, for example, microswitches, and a small plate 24 with a control circuit are arranged on the rear side of the base plate 15. The switches project into the first recesses 21.1 and are covered at the passenger space side of the wall element 9 by the flexible film 16. The film 16, as known in the art, is chosen to be flexible to the extent that, for story selection, a pressing force exerted on the film 16 aligned with a switch actuates the corresponding switch. As known, the small plate 23 with the switches and the small plate 24 with the control circuit serve as call inputting means for the lift cage. The story indicator 18 may include transparent covers 25, a display support 26 and a display 27 oriented as appropriate behind the covers. A loudspeaker support 28, which is mounted upon the rear side of the base plate 15 aligned with second perforation 22, holds the loudspeaker 19. The story indicator 18 and loudspeaker 19 provide optical and acoustic information, respectively. The call transmitter 17, story indicator 18 and loudspeaker 19 are mechanically protected on the rear side of the base plate by a cover 29 fastenable to the second limbs 11.2.

One skilled in the art will readily appreciate that adaptations, variations, and modifications to the embodiment of the invention set forth can be made without departing from the intended scope of the invention. For example, in the illustrated embodiment the control panel wall element 8 extends over the entire cage height. The control panel wall element 8 can also be made smaller, whereby only the call transmitter 17, the story indicator 18 and the loudspeaker 19 can be arranged thereon.

The flexible film 16 may serve not only as a lining for the base plate 15, but also as an information carrier. The designations of the switches, the transport capacity, manufacturer details, advertising, etc., may be printed from the rear side of the film 16, whereby the printing appearing on the user side is thus abrasion-proof and scratch-proof. The film 16 can be transparent, either with or without color. The increased material mounting costs for designation labels can be avoided by use of the printed film 16.

I claim:

1. A control panel for a lift cage having floor, ceiling and wall elements forming a passenger space, wherein the control panel is one of said wall elements said control panel wall element being engageable with adjacent wall elements to form a cage wall.

2. A control panel according to claim 1, characterized in that the control panel wall element is mountable upon the adjacent wall elements from the passenger space and the control panel wall element and adjacent wall elements form a flat cage wall bordering the passenger space.

3. A control panel according to claim 2, wherein the control panel includes rearwardly facing limbs located at opposed side edges of the control panel, said limbs having guide slots adapted to accept mounting pins located upon the adjacent wall elements.

4. A control panel according to claim 3, wherein said slots comprise vertical and horizontal slot portions.

5. A control panel according to claim 2 characterized in that the control panel wall element has a call transmitter, a story indicator and a loudspeaker and that the control panel wall element has a passenger space face lined by a flexible film.

6. A control panel according to claim 5, characterized in that the film has printed indicia on a rear side thereof, said indicia being observable from a front side of the film.

7. A lift cage wall assembly, comprising a pair of spaced wall elements, each of said wall elements having pins extending outwardly into the space between the wall elements; and a control panel having a width corresponding to the space between the wall elements, the control panel having spaced rearwardly-facing limbs, and limbs having guide slots for engagement with said pins for mounting the control panel between and flush with said spaced wall elements.

8. The wall assembly according to claim 7, wherein said guide slots comprise vertical and horizontal slot portions.

9. The wall assembly according to claim 8, wherein said spaced wall elements each have a rearwardly-directed side limb, the pins being mounted on said limbs.

* * * * *

UNITED STATES PATENT AND TRADEMARK OFFICE

CERTIFICATE OF CORRECTION

PATENT NO. : 6,029,778

DATED : February 29, 2000

INVENTOR(S) : Jose Luis Lacarte Estallo

It is certified that error appears in the above-identified patent and that said Letters Patent is hereby corrected as shown below:

Title page, item [30],
Foreign Application Priority Data should read

Mar. 6 1997 [CH] Switzerland.....0533/97

Signed and Sealed this

Sixteenth Day of January, 2001

*Attest:*

*Attesting Officer*

Q. TODD DICKINSON

*Commissioner of Patents and Trademarks*